US006393229B1

(12) United States Patent
Toyohara

(10) Patent No.: US 6,393,229 B1
(45) Date of Patent: May 21, 2002

(54) IMAGE FORMING APPARATUS

(75) Inventor: Yuichiro Toyohara, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,707

(22) Filed: Nov. 28, 2000

(30) Foreign Application Priority Data

Nov. 30, 1999 (JP) ..... 11-341254

(51) Int. Cl.[7] ..... G03G 15/00; G03G 15/06

(52) U.S. Cl. ..... 399/50; 399/53

(58) Field of Search ..... 399/50, 53, 55, 399/46, 38

(56) References Cited

U.S. PATENT DOCUMENTS 6,041,197 A * 3/2000 Kashihara ..... 399/50
6,160,569 A * 12/2000 Fujimori et al. ..... 399/50 X

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image forming device for forming a toner image on a recording material and a fixing device for fixing the toner image on the recording. An image forming speed at which the toner image is formed by the image forming device is adapted to be selected to be a first speed or a second speed greater than the first speed. A control device is provided so that, when the second speed is selected, a maximum toner amount per unit area of the toner image becomes smaller than that when the first speed is selected.

11 Claims, 5 Drawing Sheets

IMAGE FORMING APPARATUS

BACKGROUND OF THE INVENTION

1. Field of the Invention

The present invention relates to an image forming apparatus such as an electrophotographic apparatus.

2. Related Background Art

Nowadays, colorization of image information has been progressed, and there are needs for higher speed output, reduced costs, and more sharpness of hard copies accordingly. Thus, also in electrophotographic image forming apparatuses, various devices have been attempted to meet such needs.

For example, in order to meet the needs for high speed output, four image bearing members are provided so that, by effecting image formation (charging, exposure and development) independently for each color (referred to as "four-drum system" hereinafter), the image forming speed is increased by four times.

Further, by changing a fixing speed to cope with the kind of transfer material, high image quality has been achieved for various transfer materials. For example, when the image is formed on a thick sheet or an OHP sheet, generally, the fixing speed is decreased. When the fixing speed is decreased, by using a fixing convey belt, the fixing speed can be changed while keeping rotational speeds of the image bearing members (photosensitive members) constant.

However, since a distance between a transfer station and a fixing station cannot be decreased, in such a method, the entire image forming apparatus tends to be bulky. To avoid this, an attempt in which rotational speeds of the photosensitive members are changed has been proposed. By using such an attempt, the dimension of the entire image forming apparatus can be reduced and the cost can also be reduced.

However, in the above-mentioned conventional full-color image forming apparatus, although high speed output has been achieved to some extent, high speed output as in a monocolor image forming apparatus cannot be achieved. The reason is that, in the full-color image formation, the total amount of used toner is generally greater than that in the monocolor image formation, if the high speed output is attempted, there arises a problem that the fixing ability will be more formation.

SUMMARY OF THE INVENTION

The present invention aims to eliminate the above-mentioned conventional drawbacks, and an object of the present invention is to provide an image forming apparatus capable of achieving high speed image formation and high image quality.

DETAILED DESCRIPTION OF THE PREFERRED EMBODIMENTS

The present invention will now be explained in connection with embodiments thereof with reference to the accompanying drawings.

Figure 1:
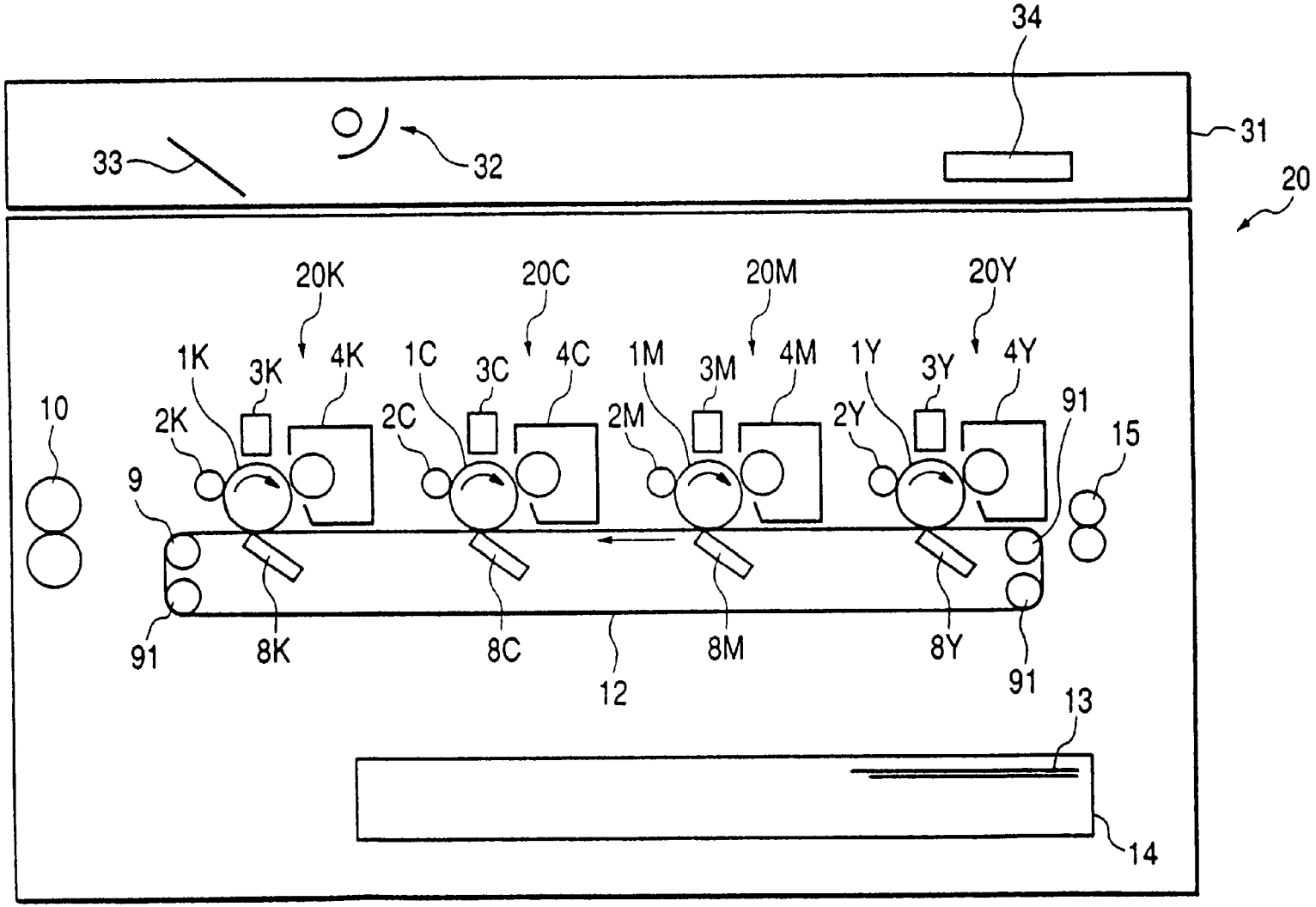
FIG. 1 is a sectional view showing a schematic construction of an image forming apparatus according to a first embodiment of the present invention.

FIG. 1 shows a schematic construction of an image forming apparatus according to a first embodiment of the present invention.

In FIG. 1, a full-color image forming apparatus 20 using a four-drum system includes four image forming stations 20Y, 20M, 20C and 20K. Further, these image forming stations 20Y, 20M, 20C and 20K include photosensitive drums 1Y, 1M, 1C, 1K as image bearing members rotated at a predetermined peripheral speed (process speed) in directions shown by the arrows, charging rollers 2Y, 2M, 2C, 2K for uniformly charging surfaces of the photosensitive drums 1Y, 1M, 1C, 1K with predetermined polarity and potential, LEDs 3Y, 3M, 3C, 3K as exposing means for forming electrostatic latent images on the photosensitive drums by exposure, and developing devices 4Y, 4M, 4C, 4K for developing the electrostatic latent image formed on the photosensitive drums by the exposure of the LEDs 3Y, 3M, 3C, 3K with Y (yellow) toner, M (magenta) toner, C (cyan) toner and B (black) toner, respectively.

Further, a transfer convey belt 12 are mounted around a drive roller 9 and driven rollers 91 and is rotated at a predetermined peripheral speed in a direction shown by the arrow by the drive roller 9. Transfer chargers 8Y, 8M, 8C, 8K and the photosensitive drums 1Y, 1M, 1C, 1K define transfer nips therebetween. Transfer materials 13 as recording materials contained in a cassette 14 are fed out by means of a conveying roller 15 and the like. While the transfer material 13 is being passed through the transfer nips, toner images formed and borne on the photosensitive drums 1Y, 1M, 1C, 1K are successively transferred onto the transfer material 13 by transfer biases applied from bias power sources (not shown) to the transfer chargers 8Y, 8M, 8C, 8K.

On the other hand, in FIG. 1, there is provided an image reading portion 31 in which light from a light source 32 is illuminated onto an original (not shown) rested on an upper surface of the image reading portion, and an image of the original is read by inputting light reflected from the original onto an CCD 34 through a mirror 33. The reading light inputted to the CCD 34 is subjected to image processing by means of an image processing portions which will be described later and then is inputted to the LEDs 3Y, 3M, 3C, 3K. The LEDs 3Y, 3M, 3C, 3K serve to effect exposure on the basis of the inputted signals.

Incidentally, in the illustrated embodiment, an image signal from a computer (not shown) may be inputted to the LEDs 3Y, 3M, 3C, 3K. In such a case, the LEDs 3Y, 3M, 3C, 3K perform the exposure on the basis of such input signals.

Next, an image forming operation of the image forming apparatus having the above-mentioned construction will be described.

In the image formation, first of all, as a charging step, the surface of the photosensitive drum 1Y in the first image forming station 20Y is uniformly charged by the charging roller 2Y with the predetermined polarity and potential while the photosensitive drum 1Y is being rotated. Then, as an exposing step, an electrostatic latent image corresponding to a first color (yellow) component of a target color image is formed on the surface of the photosensitive drum 1Y by the exposure of the LED 3Y. Incidentally, for each pixel, a reproduction gradation number is in binary values.

Then, as a developing step, the electrostatic latent image is developed by the first developing device (yellow developing device) 4Y to form a first color yellow toner image. Thereafter, as a transferring step, the first color yellow toner image formed and borne on the photosensitive drum 1Y is electrostatically transferred onto the transfer material 13 by the transfer bias applied from the bias power source to the transfer charger 8Y while the transfer material 13 fed from the sheet feeding cassette 14 at the predetermined timing and borne on the transfer convey belt 12 (rotated at the predetermined peripheral speed in the direction shown by the arrow by the drive roller 9) is being passed through the transfer nip between the transfer convey belt 12 and the photosensitive drum 1Y.

Further, also in the second to fourth image forming stations 20M, 20C, 20K, image forming processes similar to that in the first image forming station 20Y are effected at predetermined timings. In this way, yellow, magenta, cyan and black toner images are successively transferred onto the transfer material 13 in a superimposed fashion, thereby obtaining the target full-color image at a high speed.

Thereafter, the transfer material 13 to which the toner images were transferred is separated from the transfer convey belt 12 and then is introduced into a fixing device 10 of heat roller type, where the toner images are thermally fixed to the transfer material 13.

By the way, the image forming apparatus 20 according to the illustrated embodiment is provided with a high speed mode and a standard mode as image forming modes. Incidentally, an image forming speed in the high speed mode is 150 mm/sec (a fixing speed is substantially the same as this speed), and an image forming speed in the standard mode is 100 mm/sec (a fixing speed is substantially the same as this speed). Further, an image outputting speed (the number of image outputs per unit time) is 30 ppm (print per minute) in the high speed mode and 20 ppm in the standard mode. In the standard mode, although the image forming speed is slower than that in the high speed mode, image quality is higher than that in the high speed mode. The kind of the transfer material used in the standard mode is the same as that used in the high speed mode, and, in the illustrated embodiment, plain paper is used. Selection between the standard mode and the high speed mode is effected by the user by using an operating portion of the apparatus 20.

Figure 2:
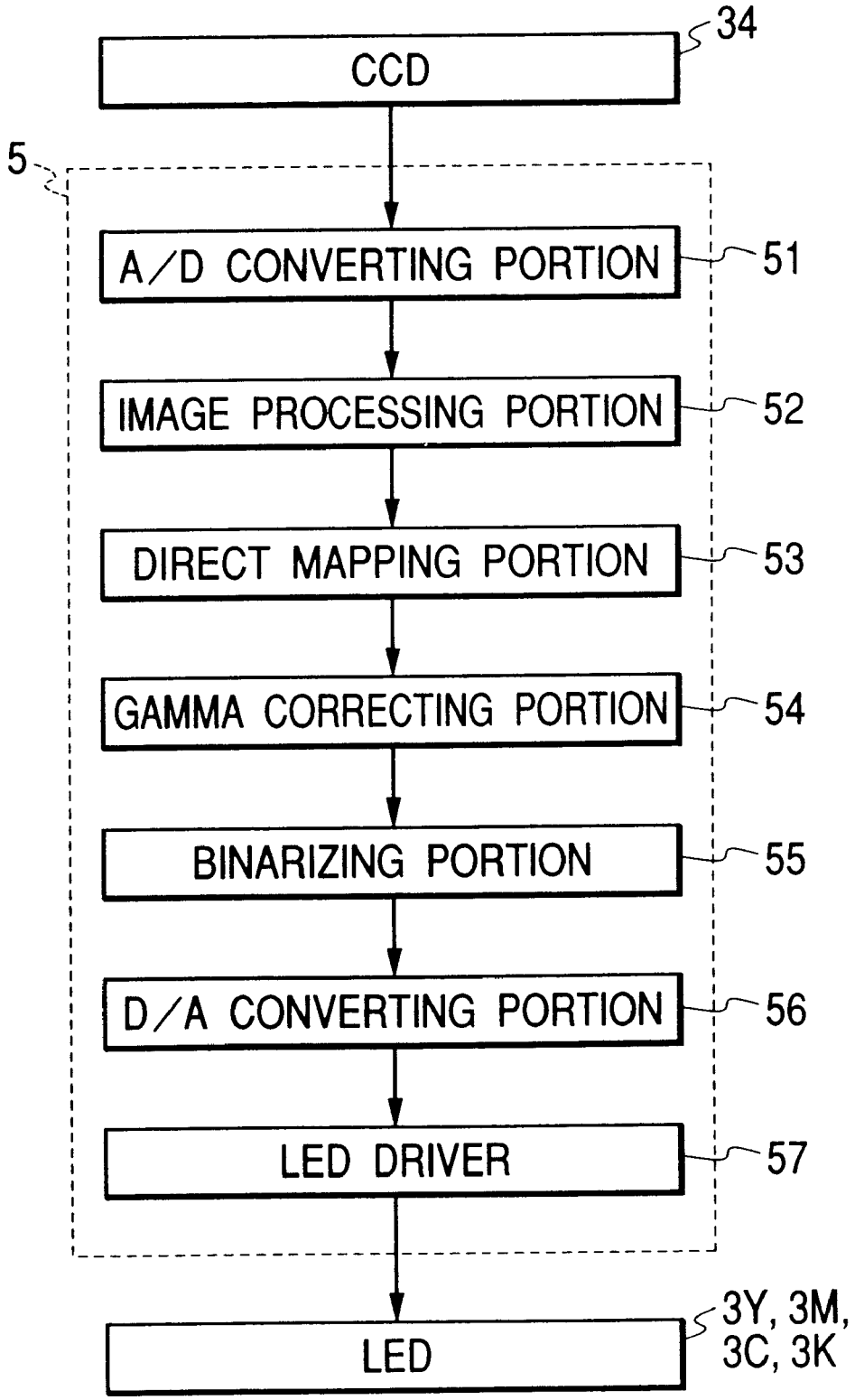
FIG. 2 is a block diagram of an image processing portion of the image forming apparatus.

FIG. 2 is a block diagram of the image forming apparatus. Now, the image formation performed when the standard mode is selected will be explained with reference to FIG. 2.

RGB signals inputted from the image reading portion 31 (CCD 34) or the computer are firstly A/D-converted in an A/D converting portion 51 of an image processing device 5 and are subjected to predetermined processing in an image processing portion 52. Thereafter, the signals are converted into YMCK signals in a direct mapping portion 53.

Then, after a printer gamma property is optimized by effecting gamma conversion processing in a gamma correcting portion 54, 8-bit YMCK signals are converted into 1-bit in a binarizing portion 55. Lastly, the YMCK signals converted to 1-bit are D/A-converted in a D/A converting portion 56 and then are sent to LED drivers 57 by which the signals are outputted to the LEDs 3Y, 3M, 3C, 3K.

When it is assumed that an image signal providing maximum density for each color 8-bit input is ffh (hexadecimal scale), a maximum toner carrying amount of ffh per one color during image formation (single color image formation) in the standard mode is 0.5 mg/cm$^2$, and, the density of each color in this case becomes 1.60. Further, the processing is effected in the direct mapping portion 53 so that total toner carrying amounts in second order (two color superimposition), third order (three color superimposition) and fourth order (four color superimposition) colors become 1.4 mg/cm$^2$ at the maximum.

Incidentally, regarding such toner carrying amounts, in the standard mode, when the image outputting speed of 20 ppm is achieved by using the image forming speed of 100 mm/sec, the toner amount by which adequate fixing ability can be obtained is a value determined by 1.4 mg/cm$^2$ and is an amount capable of providing sufficient color reproduction in the standard mode.

By the way, in the illustrated embodiment, the density, i.e., maximum toner carrying amount (maximum toner amount per unit area for developing the electrostatic latent image) is reduced by selecting developing contrast in the high speed mode to be smaller than that in the standard mode to obtain high image quality to some extent.

Figure 6:
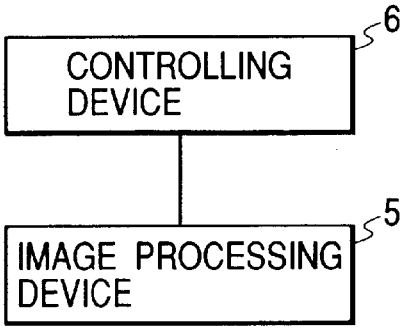
FIG. 6 is a block diagram of a control device.

To this end, as shown in FIG. 6, a controlling device 6 for setting an image formation process condition in accordance with the image forming mode selected, so that, when the high speed mode is selected as the image forming mode, the image processing device 5 is controlled by the controlling device 6 to set the process condition for reducing the maximum toner carrying amount per unit area. In the high speed mode, by reducing the maximum toner carrying amount per unit area in comparison with the standard mode in this way, a high speed image output can be achieved while always maintaining good fixing ability.

Figure 3:
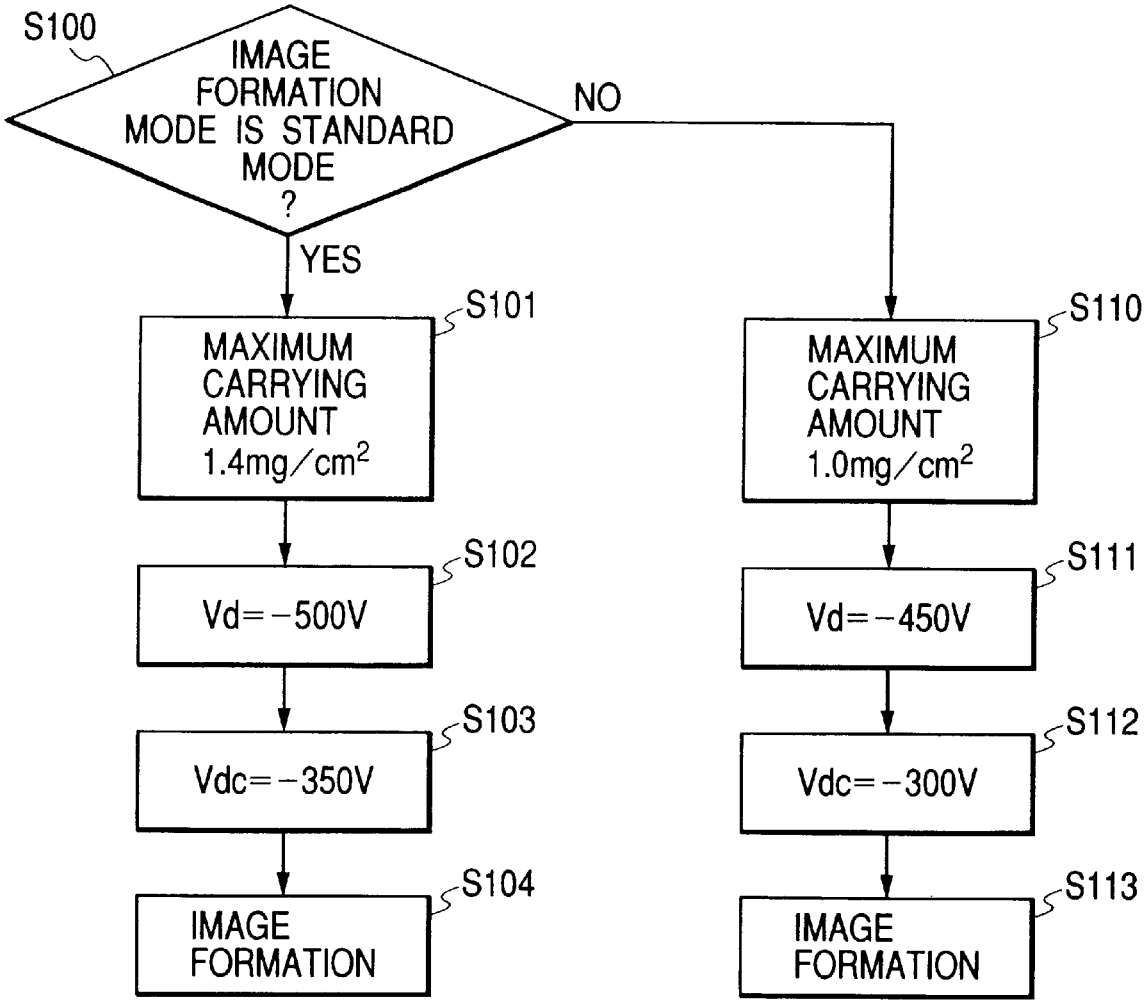
FIG. 3 is a flowchart for explaining a process condition setting operation in a standard mode and a high speed mode of the image forming apparatus.

Next, the process condition setting operations in the standard mode and in the high speed mode of the image forming apparatus will be explained with reference to a flowchart shown in FIG. 3.

First of all, the controlling device 6 judges whether the image forming mode is the standard mode or the high speed mode (step S100). If the standard mode is selected as the image forming mode ("Y" in the step S100), the maximum carrying amount after the transferring to the transfer material is selected to 1.4 mg/cm$^2$ (step S101). Incidentally, in this case, when it is assumed that the image signal providing the maximum density for each color 8-bit input is ffh (hexadecimal scale), the maximum toner carrying amount of ffh per one color during image formation is 0.5 mg/cm$^2$, and, the density of each color in this case becomes 1.60.

Further, to achieve such carrying amount, primary charging potential Vd of the photosensitive drum is set to −500 V (step S102) by controlling the voltage applied to the charging roller and a DC component value Vdc of the developing bias to the developing device is set to −350 V (step S103).

Incidentally, when the primary charging potential Vd and the DC component value Vdc of the developing bias are set in this way by controlling the charging condition and the developing condition, potential Vff of a portion exposed with ffh becomes −150 V. Further, developing contrast (Vff−Vdc) becomes 200 V and Vback (Vdc−Vd) becomes −150 V. However, these values are values obtained under an environment (temperature of 24° C., humidity of 60%) and are controlled to optimum values by the controlling device on the basis of temperature/humidity data detected by an environment sensor (not shown) so that the carrying amount for each color becomes 0.5 mg/cm$^2$.

And, by visualizing the image signal processed under such condition, the nonstandard mode image is performed (step S113).

On the other hand, if the high speed mode is selected as the image forming mode ("N" in the step S100), the control is performed so that the maximum toner carrying amount of ffh per one color during image formation (single color image formation) becomes is 0.4 mg/cm$^2$, and the maximum toner carrying amounts in second order (two color superimposition), third order (three color superimposition) and fourth order (four color superimposition) colors become 1.0 mg/cm$^2$ (step S110). In this case, as the process condition, the primary charging potential Vd is set to −450 V (step S111) and the DC component value Vdc of the developing bias is set to −300 V (step S112).

Figure 4:
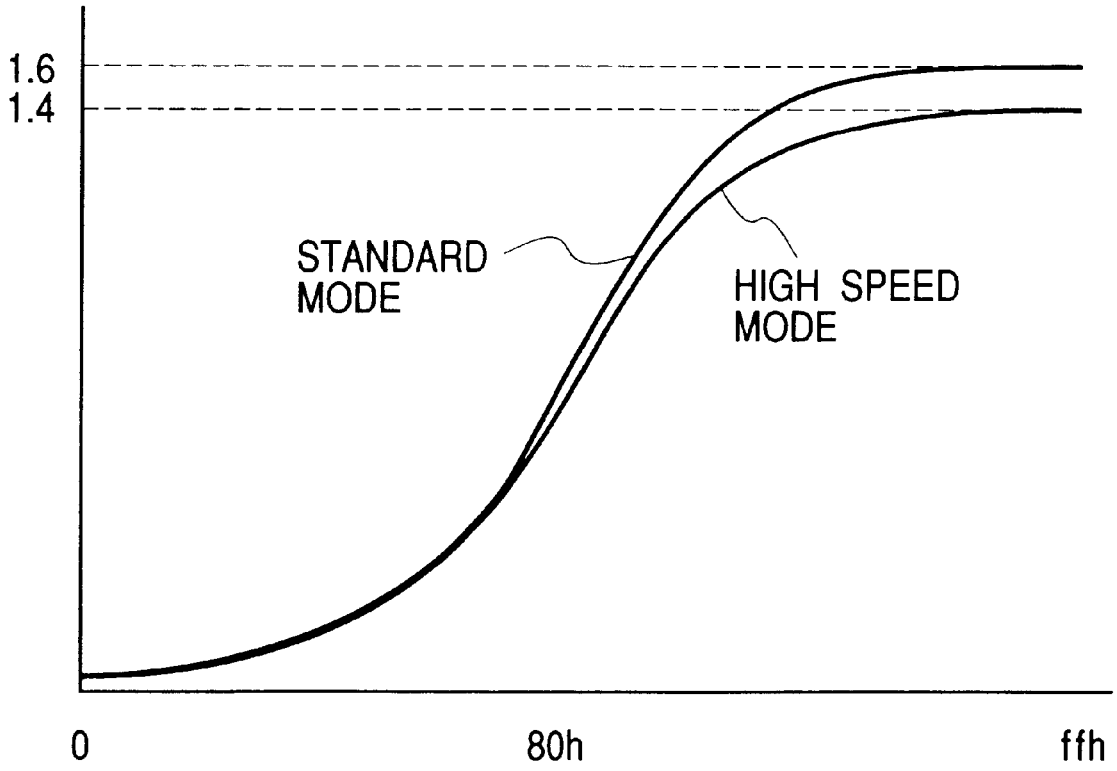
FIG. 4 is a view showing a gamma properties in the standard mode and the high speed mode of the image forming apparatus.

By the way, in this case, the potential Vff of a portion exposed with ffh is −150 V and the developing contrast (Vff−Vdc) is 150 V. In case of the high speed mode, by reducing the developing contrast (Vff−Vdc) (150 V) smaller than the standard mode by 50 V while maintaining the Vback unchanged (−150 V), as shown in FIG. 4, the density can be reduced totally without changing the configuration of the gamma property of the printer with respect to the standard mode.

As a result, although the color reproduction range is slightly smaller than that in the standard mode, the image outputting speed of 30 ppm can be achieved at the image forming speed of 150 mm/sec without deteriorating the fixing ability. Further, in this case, as shown in FIG. 4, the processing is performed in the direct mapping portion so that the maximum toner carrying amounts in second order, third order and fourth order colors become 1.0 mg/cm$^2$.

In this way, by changing the maximum toner carrying amounts by changing the developing contrast in accordance with the change in image forming speed, the high speed image output can be achieved while always maintaining the good fixing ability. Further, in the standard mode, good color reproductivity can be provided, with the result that both the high speed mode and the standard mode capable of providing the good color reproduction can be compatible in the single image forming apparatus.

In the above explanation, while an example that. the maximum toner carrying amounts are changed by changing the developing contrast in accordance with the change in image forming speed was explained, the present invention is not limited to such an example, but, the maximum toner carrying amounts may be changed without changing the contrast.

Figure 5:
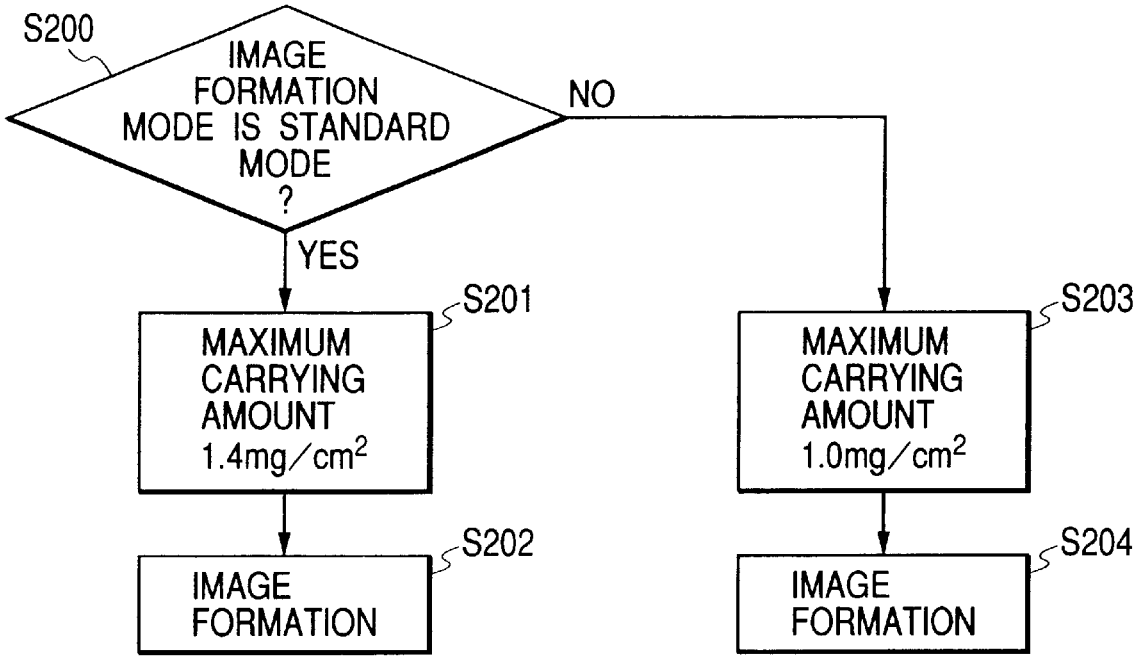
FIG. 5 is a flowchart for explaining a controlling operation in a standard mode and in a high speed mode of an image forming apparatus according to a second embodiment of the present invention.

FIG. 5 is a flowchart for explaining a controlling operation of an image forming apparatus according to a second embodiment of the present invention in which maximum toner carrying amounts are changed without changing contrast.

Now, the controlling operations in a standard mode and in a high speed mode will be described with reference to this flowchart.

First of all, the controlling device judges whether the image forming mode is the standard mode or the high speed mode (step S200). If the standard mode is selected as the image forming mode ("Y" in the step S200), the maximum carrying amount is selected to 1.4 mg/cm$^2$ (step S201). In this case, when it is assumed that the image signal providing the maximum density for each color 8-bit input is ffh (hexa-decimal scale), the maximum toner carrying amount of ffh per one color during image formation is 0.5 mg/cm$^2$, and, the density of each color in this case becomes 1.60.

Incidentally, regarding the maximum toner carrying amount of ffh per one color during image formation, when the image outputting speed of 20 ppm is achieved by using the image forming speed of 10 mm/sec, the toner amount by which adequate fixing ability can be obtained is a value determined by 1.4 mg/cm$^2$ and is an amount capable of providing sufficient color reproduction in the standard mode.

To achieve such carrying amount, primary charging potential Vd of the photosensitive drum is set to −150 V and a DC component value Vdc of the developing bias to the developing device is set to −350 V. Further, potential Vff of a portion exposed with ffh is set to −150 V. Namely, developing contrast (Vff−Vdc) is 200 V and Vback (Vdc−Vd) is −150 V. However, these values are values obtained under an environment (temperature of 24° C., humidity of 60%) and are controlled to optimum values by the controlling device on the basis of temperature/humidity data detected by an environment sensor (not shown) so that the carrying amount for each color becomes 0.5 mg/cm$^2$.

And by visualizing the image signal processed under such process condition, the standard mode image is formed (step S202).

On the other hand, if the high speed mode is selected as the image forming mode ("N" in the step S200), in the illustrated embodiment, the process condition is set to be the same as that in the standard mode, and the processing effected by the direct mapping portion is changed. That is to say, the carrying amount of ffh per one color is not changed, and the maximum toner carrying amounts in second order, third order and fourth order colors are set to 1.0 mg/cm$^2$ (step S203).

And by visualizing the image signal processed under such process condition, the high speed mode image is formed (step S204).

By changing the maximum toner carrying amounts in second order, third order and fourth order colors without changing the carrying amount of ffh per one color by the image processing in this way, the maximum toner carrying amounts can be changed without changing the contrast, with the result that the toner carrying amount can be set in accordance with the process speed so that the satisfactory fixing ability can be provided in any process speed.

As mentioned above, according to the present invention, when the image formation is performed at the high image forming speed, high speed and high image quality requirements of the image formation can be achieved by reducing the maximum toner amount per unit area in comparison with the low speed image formation.

What is claimed is:

1.An image forming apparatus comprising:

image forming means for forming a toner image on a recording material;

fixing means for fixing the toner image on the recording material, wherein an image forming speed at which the toner image is formed by said image forming means being adapted to be selected to a first speed or a second speed greater than the first speed; and control means for controlling so that, when the second speed is selected, a maximum toner amount per unit area of the toner image becomes smaller than that when the first speed is selected.

2. An image forming apparatus according to claim 1, wherein said image forming means includes an image bearing member, means for forming the toner image on said image bearing member, and transfer means for transferring the toner image from said image bearing member to the recording material, and wherein, when the second speed is selected, the maximum toner amount per unit area of the toner image formed on said image bearing member becomes smaller than that when the first speed is selected.

3. An image forming apparatus according to claim 1, wherein said image forming means includes an image bearing member, electrostatic latent image forming on said image bearing member,developing means for developing the electristatic latent image with toner to form the toner image on said image bearing member, and transfer bearing member to the recording material, and wherein, when the second speed is selected, the maximum toner amount per unit area of the toner image developed by said developing means becomes smaller than that when the first speed is selected.

4. An image forming apparatus according to claim 3, wherein the maximum toner amount is changed by changing a developing condition of said developing means.

5. An image forming apparatus according to claim 4, wherein said electrostatic latent image forming means includes charging means for charging said image bearing member, and wherein the maximum toner amount is changed by changing a charging condition of said charging means.

6. An image forming apparatus according to claim 3, wherein said electrostatic latent image forming means includes charging means for charging said image bearing member, and wherein the maximum toner amount is changed by changing a charging condition of said charging means.

7. An image forming apparatus according to claim 3, wherein said electrostatic latent image forming means includes charging means for charging said image bearing member, and exposing means for image-exposing said image bearing member charged by said charging means based on an image signal, and further wherein the maximum toner amount is changed by changing the image signal.

8. An image forming apparatus according to claim 1, wherein said fixing means includes a fixing roller.

9. An image forming apparatus according to claim 1, wherein the toner image is formed from a plurality of superimposed color toners.

10. An image forming apparatus according to claim 1, wherein a kind of the recording material to be used is the same regardless of selection between the first speed and the second speed.

11. An image forming apparatus according to claim 1, wherein the recording material to be used is plain paper regardless of selection between the first speed and the second speed.

* * * * *

UNITED STATES PATENT AND TRADEMARK OFFICE

CERTIFICATE OF CORRECTION

PATENT NO. : 6,393,229 B1
DATED : May 21, 2002
INVENTOR(S) : Yuichiro Toyohara

It is certified that error appears in the above-identified patent and that said Letters Patent is hereby corrected as shown below:

Column 1,
Line 62, “properties” should read -- property --.

Column 4,
Line 5, “(two color” should read -- (two-color --;
Line 6, “(three color” should read -- (three-color --;
Line 7, “(four color” should read -- (four-color --;
Line 66, “nonstandard” should read -- standard --; and “performed” should read -- formed --; and
Line 67, “(step S113).” should read -- (step S104.) --.

Column 5,
Line 5, “becomes is” should read -- becomes --;
Line 6, “(two color” should read -- (two-color --;
Line 7, “(three color” should read -- (three-color --;
Line 8, “(four color” should read -- (four-color --;
Line 12, “(step S112).” should read -- (step S112). ¶And, by visualization the image signal processed under such condition, the nonstandard mode image is performed (step S113). --; and
Line 39, “that.” should read -- that --.

Column 6,
Line 48, “1.An” should read -- 1. An --.

UNITED STATES PATENT AND TRADEMARK OFFICE

CERTIFICATE OF CORRECTION

PATENT NO. : 6,393,229 B1
DATED : May 21, 2002
INVENTOR(S) : Yuichiro Toyohara

It is certified that error appears in the above-identified patent and that said Letters Patent is hereby corrected as shown below:

Column 7,
Line 6, “forming” should read -- forming means for forming an electrostatic latent image --;
Line 7, “member,developing” should read -- member, developing --; and
Line 9, “transfer” should read -- transfer means for transferring the toner image from said image --.

Signed and Sealed this

Fifteenth Day of October, 2002

*Attest:*

*Attesting Officer*

JAMES E. ROGAN
*Director of the United States Patent and Trademark Office*